United States Patent [19]

Widén

[11] 4,047,137

[45] Sept. 6, 1977

[54] BISTABLE POSITION INDICATING DEVICE

[75] Inventor: Birger Widén, Tierp, Sweden

[73] Assignee: Widéns Elautomatik AB, Tierp, Sweden

[21] Appl. No.: 665,408

[22] Filed: Mar. 10, 1976

[30] Foreign Application Priority Data

Mar. 19, 1975 Sweden ..... 7503123

[51] Int. Cl.[2] ..... H01F 7/08

[52] U.S. Cl. ..... 335/234; 335/272

[58] Field of Search ..... 335/229, 230, 234, 272; 340/373, 378 MM

[56] References Cited

U.S. PATENT DOCUMENTS

| | | | |
|---|---|---|---|
| 3,185,979 | 5/1965 | Jackman | 335/230 X |
| 3,368,216 | 2/1968 | Rose | 340/373 |
| 3,470,509 | 9/1969 | Silverman et al. | 335/229 |
| 3,479,626 | 11/1969 | Silverman et al. | 335/272 X |

*Primary Examiner*—George Harris

[57] ABSTRACT

A bistable position indicating device comprising a fixed and a movable part, the latter being provided with two portions having different colors and arranged to be switched to one or the other color portion position by means of coaction between a permanent magnet and an electromagnet having mutually setable positions. The movable part comprises an elongate body such as a cylinder, which has its envelope surface axially divided into said two portions of different colors, and is turnably arranged about its central axis. The electromagnet is provided with pole shoes arranged to meet the poles of the permanent magnet, both the magnets being, on the application of a current pulse to the electromagnet coil, through coaction between the fields of the magnet and the coil, turned in relation to each other so that the movable part is turned through an angle less than 180°, particularly mainly 180°, and is reset from one color position to the other and vice versa.

4 Claims, 12 Drawing Figures

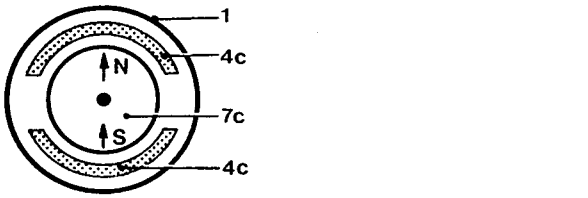
Fig.4b
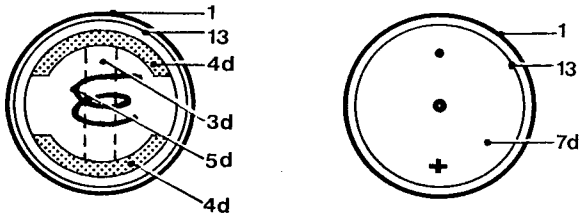
Fig.5b
Fig.5c
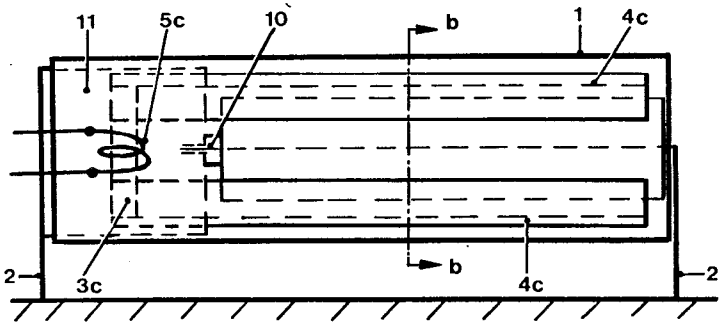
Fig. 4a
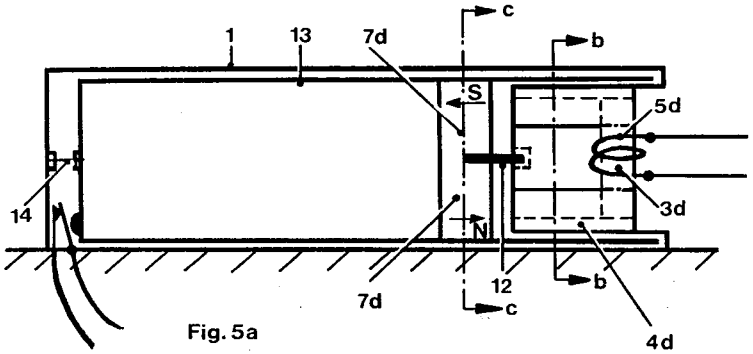
Fig.5a

BISTABLE POSITION INDICATING DEVICE

The present invention relates to a bistable position indicating device comprising a fixed and a movable part, the latter being provided with portions of different colours, and being arranged to be moved to a certain coloured portion by means of a combination of a permanent magnet and an electromagnet having mutually adjustable positions.

The object of the present invention is to provide a simpler, cheaper and more flexible indicating device than those used so far.

The invention is hereby mainly distinguished in that the movable part of the bistable device comprises an elongate body, such as a cylinder, having its envelope surface axially divided into two different coloured portions, and which is arranged for turning round its central axis, and in that the electromagnet is provided with pole shoes which are arranged to meet the poles of the permanent magnet, whereby, through co-action between the fields from the coil and the permanent magnet on supplying a current pulse to the coil of the electromagnet, both magnets are turned in relation to each other so that the movable part is turned through an angle less than 180°, or an angle which is somewhat less than 180°, and is reset from the position showing one colour to the other position, or vice versa.

Figure 1A:
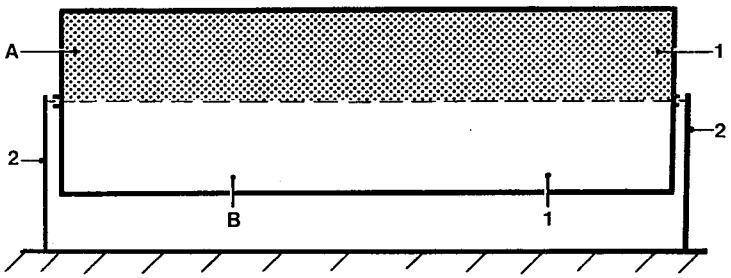
Figure 1B:
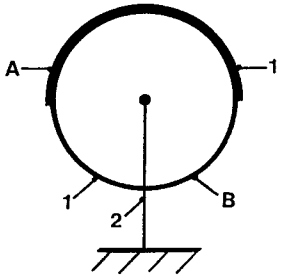

Embodiments of the invention will now be more closely described in the following while referring to the accompanying drawing, where FIG. 1*a* is a side view of a bistable device according to the invention, and FIG. 1*b* is an end view of the device in FIG. 1*a;*

Figure 2A:
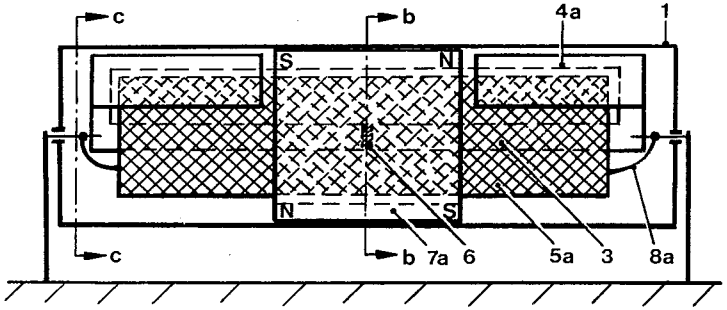
Figure 2B:
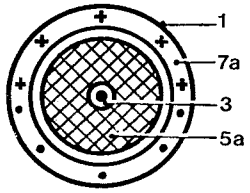
Figure 2C:
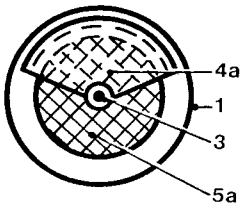

FIG. 2*a* shows a first embodiment of the invention in a longitudinal section, FIG. 2*b* is a section along the line b—b in FIG. 2*a,* and FIG. 2*c* is a section along the line c—c in FIG. 2*a;*

Figure 3A:
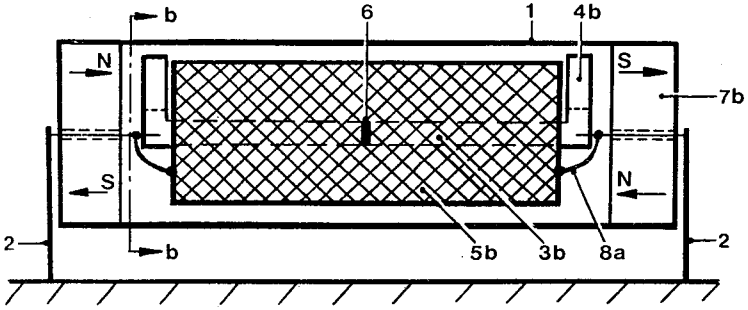
Figure 3B:
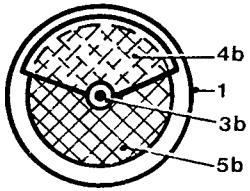

FIG. 3*a* shows a longitudinal section through a second embodiment of the invention, and FIG. 3*b* is a section along the line b—b in FIG. 3*a;*

FIG. 4*a* shows a third embodiment in a longitudinal section, and

FIG. 4*b* is a section along line b—b in FIG. 4*a;*

FIG. 5*a* shows a fourth embodiment in a longitudinal section,

FIG. 5*b* being a section along the line b—b in FIG. 5*a* and

FIG. 5*c* being a section along the line c—c in FIG. 5*a.*

FIGS. 1*a* and 1*b* show a turnable outer casing 1 which is mounted in supports 2. Half the longitudinal surface of this casing comprises a dark portion A, such as black, and the other half a light portion B, which may be red, for example. This light portion may also consist of a reflecting colour. The turnable casing which can be tubular, for example, is suitably placed in an opening, or so-called "window" in an indicating panel. By turning the casing round the centre axis substantially 180° or somewhat less, the window can thus show light or dark. Turning is accomplished by having a stearing pulse supplied to a magnetic coil arranged in the casing, the coil coacting with a permanent magnet also arranged in the casing. By means of this pulse the bistable device is thus turned substantially 180° in the other direction in response to the pulse polarity. By combining a number of such devices, it is possible to form figures, letters and other configurations. For example, with the help of seven such devices each of the figures 0–9 can be produced.

FIGS. 2*a,* 2*b* and 2*c* show in section an embodiment example of a bistable device according to the invention. It comprises an outer casing 1 provided with a dark and a light portion. Inside the casing there is concentrically arranged a magnetic core 3 which via trunnions is mounted in the supports 2. The core is provided with pole shoes 4*a* consisting partly of a circle sector shaped plate and partly a shell-shaped portion arranged therewith. A magnetic coil 5*a* is arranged between the core and the pole shoes. By means of having the core parted in two and the parts separated by an insulating layer 6, the supply lines 8*a* to the coil can be connected to the trunnions, whereby no extra passages in the casing ends need be arranged. On the inside of the casing 1 and between both the pole shoes 4*a* there is arranged a magnet ring 7*a* which thus envelopes the magnetic coil 5*a.* When a current pulse is supplied to the coil 5*a* the field from this coil will coact with the field from the permanent magnet, thereby turning the outer casing almost 180°. After the current in the coil is discontinued, the movable part is retained in a set position because of the remanence in the permanent magnet. For this reason, no power is consumed between each setting of the bistable device. For the next setting a current pulse of reversed polarity is supplied, whereby there is once again coaction between the electromagnetic flux and the flux from the permanent magnet, giving rise to a turn of the outer casing.

FIGS. 3*a* and 3*b* show another embodiment, which also comprises an outer casing 1 in which there is arranged a magnetic core 3*b.* This is provided with pole shoes 4*b* in the form of circle sector-shaped plates. Around the core 3*b* and between the pole shoes 4*b* there is arranged a coil 5*b.* As in the embodiment according to FIG. 2*a* the core is parted, an insulating layer 6 being introduced between the parts. In each end of the casing there are introduced permanent magnets 7*b* which are axially magnetized. These magnetic discs are provided with through holes for the trunnions mounted in the supports 2. As in the embodiment according to FIG. 2*a,* the outer casing turns substantially 180° or somewhat less, for a current pulse through the coil 5*b.*

In FIGS. 4*a* and 4*b* there is shown a third embodiment in which the outer casing turns. The casing 1 surrounds a magnetic coil 5*c* provided with a core 3*c.* The core is provided with pole shoes 4*c.* The core and coil are cast into an insulating body 11 which is arranged at one end support 2. At the end of the body 11 remote from the support 2 and via a spacer 10, there is mounted a cylindrical permanent magnet 7*c.* At its other end the magnet 7*c* is attached to the end of the outer casing 1. The magnet projects thereby somewhat farther out than the pole shoes 4*c.* This end of the magnet and the outer casing are mounted in the other support 2. In this case as well, the permanent magnet 7*c* and the casing 1 turn in relation to the fixed magnetic coil 5*c* and the core 3*c* when a current pulse is supplied to the coil. As in the previous cases, the casing turns through substantially 180°, or somewhat less. The magnet in this case is radially polarized.

In the three embodiments described above, the outer casing has turned. On the contrary, in the embodiment exemplified in FIGS. 5*a,* 5*b* and 5*c* the outer casing, which is made in a transparent material, remains still. Inside the outer casing 1 there is concentrically and turnably arranged a cylinder 13, which on its cylindrical surface is provided with a dark and a light portion, said portions being visible through the outer casing. The inner cylinder 13 is mounted at one end in the outer casing by means of a shaft 14. At its other end the outer casing is extended as shown in FIG. 5*a* so that it surrounds a magnetic coil 5*d,* arranged on a core 3*d* provided with pole shoes 4*d.* At the central axis of the coil 5*d* a permanent magnet 7*d* having the form of a disc is mounted by means of a shaft 12. This magnet is attached to the inner cylinder 13. The magnet 7*d* is axially magnetized.

For a current pulse of suitable sign through the coil 5*d,* the inner cylinder together with the magnet will be turned through substantially 180° by coaction between the field from the coil and the permanent magnet 7*d.* As in the other embodiments, the turning angle here will be somewhat less than 180°. As in the other embodiments as well, the outer casing is here made as a completely enclosed casing.

When a combination of the bistable device described above, e.g. for forming figures, is used together with an electronic display, for example, as is often the case, the device can be provided with a contact means via which a control signal is sent to the display unit. This means can thereby consist of an electromagnetic contact placed outside the outer casing or inside it, said contact being actuated when the casing has been turned through substantially 180°. Instead of a mechanical contact it is possible to use a photocell arrangement which is actuated when the casing is turned.

By means of the invention hereinbefore described, a bistable device has been achieved which is simple and cheap to manufacture. The outer casing of the device can be made hermetically sealed, if it is to be used under difficult conditions. The device can be manufactured in practically any length and configuration. It is epecially easy to build in a large format, and can further be easily mounted on circuit boards as well as other apparatus. Since it is a component, figures, letters and other characters can be built up by means of it. A still further advantage is that when the device is reset with the help of an electric impulse, there is no electrical power consumption between each setting pulse. Finally, it can be mentioned that the element is not limited to the embodiments described hereinbefore, but variations in further respects are naturally possible within the scope of the patent claims. Thus, for example, the turning angle between the different colours may have an arbitrary value between 0° and 180°, e.g. somewhat less than 90°, even if the value of "somewhat less than 180°" has been chosen for practical reasons in the preferred embodiments. Moreover, by the expression "colour" is not only meant the colours in the spectrum, but also all tones of grey from white to black.

What is claimed is:

1. An electromagnetic indicating display device including at least one pair of bistable position indicators, each bistable position indicator comprising: a non-rotatable electromagnet having a pair of pole shoes; an elongate rotatable member concentrically positioned relative to said electromagnet, the outer surface of said elongate member being circumferentially divided into first and second axially extending sections of different colors; a permanent magnet carried by said rotatable member having poles alignable respectively with the pole shoes of said electromagnet upon excitation of said electromagnet whereby said rotatable member is rotatable through an angle of not more than 180° selectively into one of two positions, the first of said positions displaying one of said first and second colored sections and information carried thereon and the second of said positions displaying the other of said colored sections and information carried thereon.

2. A display device according to claim 1, wherein said rotatable member is a cylindrical casing and said electromagnet includes a magnetic core which extends axially through said casing, trunnion means being provided at each end of said core, said core being separated at an intermediate location and an insulating element interposed between the core sections, a magnetic coil positioned between said pole shoes and the pole shoes thereof, and electrical conducting means connected to said trunnion means for energizing said coil.

3. A display device according to claim 1, including contact means cooperable with said rotatable member for generating a control signal indicative of the rotative position thereof.

4. A display device as claimed in claim 1, wherein both pole shoes of the electromagnet are positioned so as to surround the permanent magnet.

* * * * *